United States Patent [19]

Suter et al.

[11] 4,346,655

[45] Aug. 31, 1982

[54] DEVICE FOR EXCHANGING THE FORM CYLINDER IN A PHOTOGRAVURE ROTARY MACHINE

[75] Inventors: Fritz Suter, Boll; Paul Haag, Bern, both of Switzerland

[73] Assignee: Maschinenfabrik WIFAG, Switzerland

[21] Appl. No.: 144,959

[22] Filed: Apr. 29, 1980

[30] Foreign Application Priority Data

May 7, 1979 [CH] Switzerland ..... 7903974

[51] Int. Cl.[3] ..... B41F 9/18; B41F 13/20

[52] U.S. Cl. ..... 101/153; 101/216

[58] Field of Search ..... 101/152, 153, 216, 219, 101/247, 212, 155-157; 242/58.6

[56] References Cited

U.S. PATENT DOCUMENTS 2,263,323 11/1941 Wickwire, Jr. ..... 101/182

2,965,023 12/1960 Boule et al. ..... 101/352

4,137,843 2/1979 Ottenhue ..... 101/153

FOREIGN PATENT DOCUMENTS 2314523 10/1974 Fed. Rep. of Germany ..... 101/216

*Primary Examiner*—J. Reed Fisher

*Attorney, Agent, or Firm*—McGlew and Tuttle

[57] ABSTRACT

In a photogravure rotary machine, each side of the form cylinder is mounted in a bearing housing, which is secured in a saddle portion of a carriage provided with a sleeve drive. The carriage is displaceably mounted on a guide secured on a machine wall and which carries a pivotally mounted retaining fork for the bearing housing. A locking mechanism is provided for locking the carriage in its operating positon, which is in an operative connection with a switching element that is electrically connected to a machine control. In the range of the extended position of the carriage is arranged an incline with a hinged return feed ratchet for lifting the form cylinder on the machine wall.

4 Claims, 3 Drawing Figures

DEVICE FOR EXCHANGING THE FORM CYLINDER IN A PHOTOGRAVURE ROTARY MACHINE

FIELD AND BACKGROUND OF THE INVENTION

The present invention relates to a device for exchanging a form cylinder of a photogravure rotary machine which is provided on both sides with removable bearing bushings.

Devices for facilitating and simplifying the replacement of form cylinders on photogravure rotary machines are known in various forms.

Thus, for example, Swiss Pat. No. 504,303 shows a device for engaging and disengaging form cylinders where divided bearing shells are provided in two swivel arms non-rotatably connected with each other over a shaft mounted in the machine side walls to support the form cylinder pin.

This embodiment requires a cylinder transfer car which is provided with a lifting mechanism, otherwise the swivel arms could not be swung under the bearing pins of the form cylinder to be installed, nor could they be swung away from the bearing pins of a disassembled form cylinder. The swivel arms are in addition turned empty into the operating position before a new form cylinder is installed to permit maneuvering of the cylinder transfer car.

These drawbacks, as well as the loosening and tightening of the moving bearing shell halves have a negative effect on the change-over time.

It has recently become customary to roll the form cylinders manually on rails provided for this purpose into and out of the operating position, as it can be seen, e.g. from Swiss Pat. Nos. 563,876 and 571,397.

Such devices have the disadvantage that the very heavy form cylinders must be moved manually between the machine side walls. Axially parallel rolling is thus not ensured, and the splash boards necessary to cover the form cylinders at their end faces must be assembled and disassembled in their operating position to replace the form cylinder.

SUMMARY OF THE INVENTION

The object of the invention is to provide a device for exchanging these form cylinders, while avoiding the above-mentioned drawbacks.

This is achieved according to the invention in that a guide with a carriage having a saddle portion for the bearing housing which is displaceably mounted thereon, and which carries a pivotally mounted retaining fork, is arranged on each of the two machine side walls. A controllable locking mechanism for securing the carriage in its operating position and on an incline provided with a hinged return feed ratchet for lifting the form cylinder in its axis is provided in the range of the extending position of the carriage.

Accordingly, a further object of the present invention is to provide a device for exchanging a form roller of a photogravure rotary machine which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings which show one of two bearing sides of the form cylinder.

DESCRIPTION OF THE PREFERRED EMBODIMENT

Figure 1:
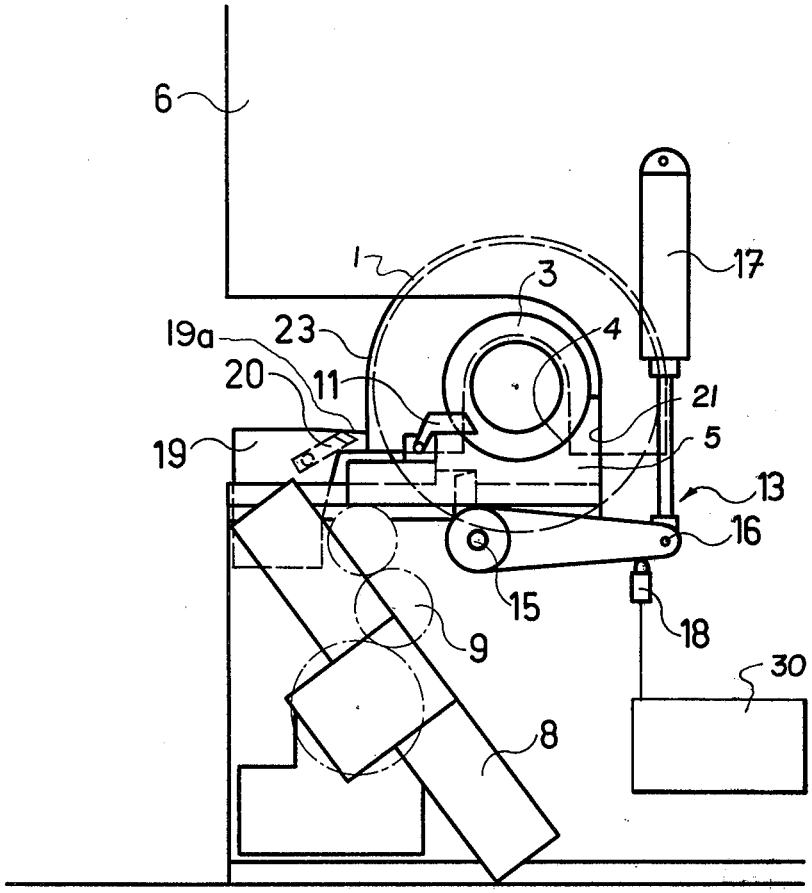
FIG. 1 is a side elevational view of a form cylinder in its operating position.
Figure 2:
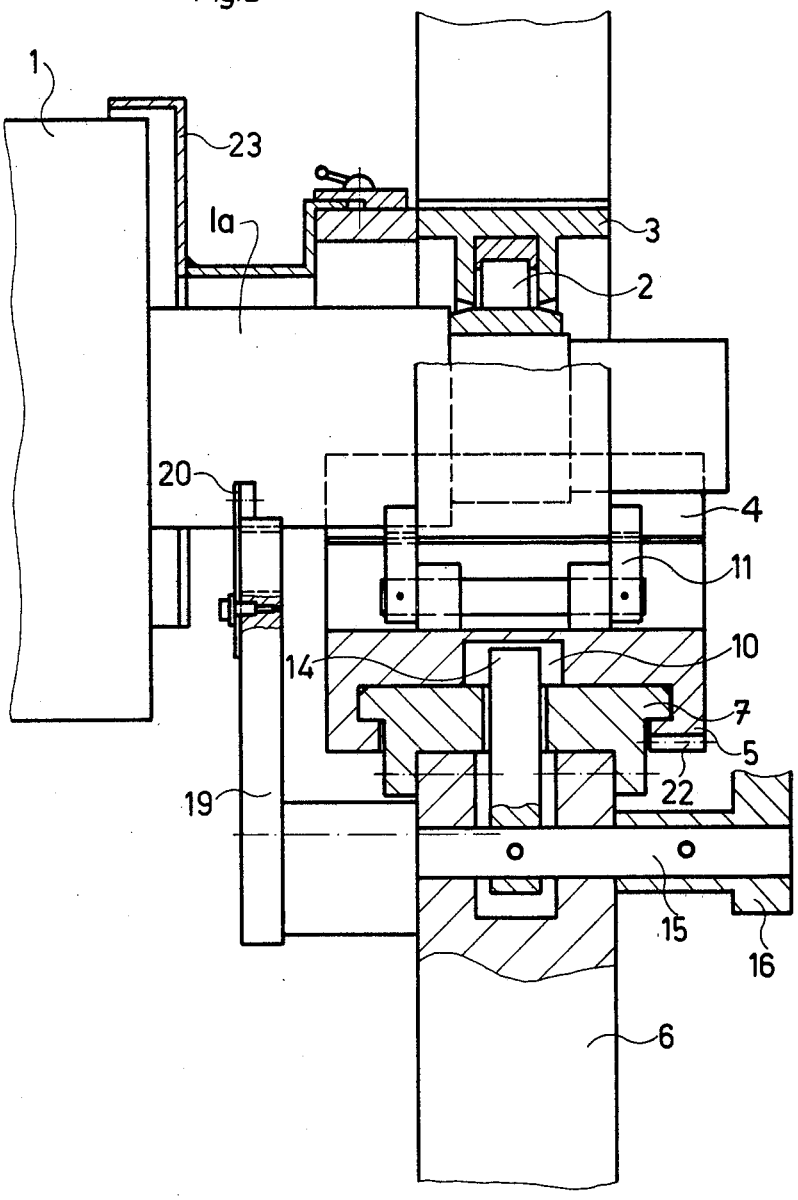
FIG. 2 is a front view, partly in section of a bearing of the invention.

Turning to the drawings in particular the invention embodied therein comprises a device for exchanging a form cylinder 1 particularly in a photogravure rotary machine.

Form cylinder 1 is mounted in a known manner, e.g. by means of a roller bearing 2, in a bearing housing 3 embracing cylinder shaft 1*a* bearing housing 3 rests and is secured in a saddle portion 4 of a carriage 5. Carriage 5 is slidably mounted on a guide 7 secured on machine wall 6 and is in operative connection with a sleeve drive, which can consist e.g. of a gear connection 9 controlled by a pneumatic rotary drive.

Carriage 5 is provided on its underside with a locking groove 10 and carries a pivotally mounted retaining fork 11 for holding bearing housing 3. End face 12 of carriage 5 serves as a stop opposite machine wall 6.

For locking carriage 5 in an operating position a locking mechanism 13 is provided. It consists of a bolt 14 which is non-rotatably connected to a lever 16 over a shaft 15 which is rotatably mounted in machine wall 6, and a controllable power source 17 acting on lever 16. A switching element 18 is associated with locking mechanism 13 which is electrically connected to the machine control so that the machine can only be started when carriage 5 is locked.

An incline member 19 having an upper inclined surface 19*a* for supporting shaft 1*a* of cylinder 1, is arranged in known manner on the inside of machine wall 6 which is provided with a pivotally mounted return feed ratchet 20 for holding shaft 1*a* on the incline.

According to FIG. 1, bearing housing 3 rests in the operating position of form cylinder 1 in a saddle portion 4 of carriage 5, which is locked by means of locking mechanism 13 and bolt 14 against stop surface 21 of machine wall 6. Switching element 18 is actuated and closes the circuit of the machine control 30. Retaining fork 11 is turned up to hold housing 30 and return feed ratchet 20 is turned down.

Figure 3:
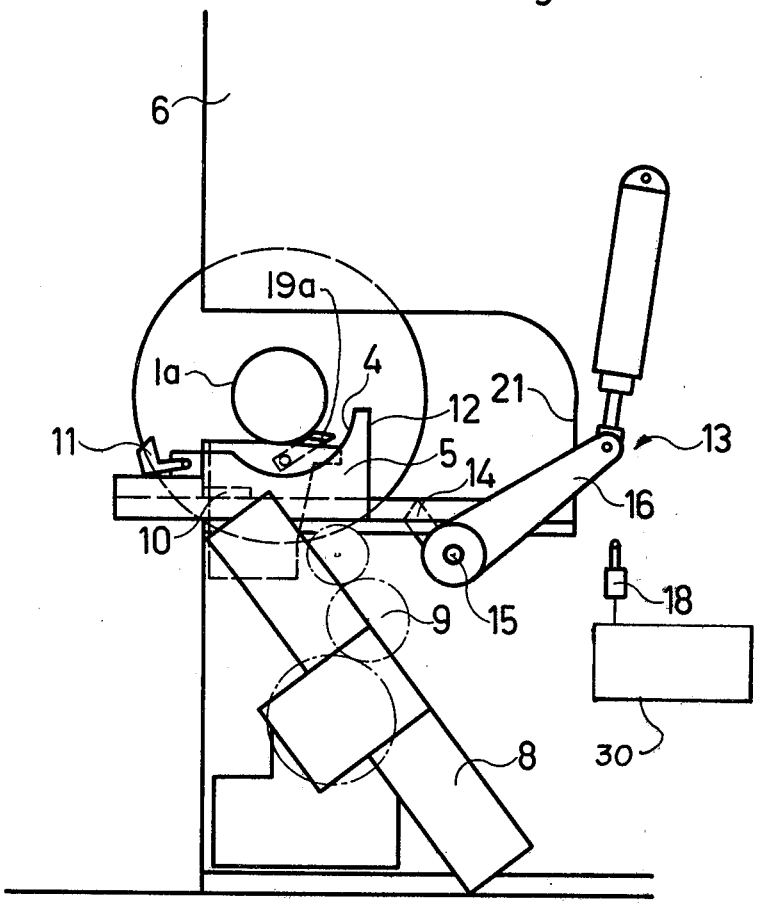
FIG. 3 is a side elevational view of the form cylinder extended, with the splash board and bearing housing removed.

For replacing form cylinder 1, lever 16 is first lifted by power source 17, and carriage 5 is thus unlocked and the circuit of the machine control 30 is interrupted by switching element 18. The pneumatic rotary drive 8 synchronized with that of the other machine side (not shown) is now pressurized in known manner, and carriage 5 is extended by means of a gear connection 9 and rack 22 which is formed on the bottom of carriage 5. Shortly before reaching the extended end position, (FIG. 3) the shaft axis 1*a* of form cylinder 1 strikes incline 19, so that form cylinder 1 and thus also bearing housing 3 are lifted. After reaching the end position according to FIG. 3, return feed ratchet 20 is turned up manually, and retaining fork 11 is turned back. Bearing housing 3 can now be removed and a splash board 23, which is of known structure, is disassembled.

The replacement of form cylinder 1 is effected in known manner, not specifically shown here, by rolling it over connecting rails onto a cylinder transfer car.

The introduction of a new form cylinder is effected in reverse order. Form cylinder 1 is rolled from cylinder transfer car to return feed ratchet 20, splash board 23 is mounted, bearing housing 3 is pushed over and secured by retaining fork 11. After turning return feed ratchet 20 back, carriage 5 is retracted again by sleeve drive and form cylinder 1 while bearing housing 3 is automatically centered in saddle portion 4 by its own weight after running off incline 19. After reaching the operating position, carriage 5 is locked by means of the locking mechanism 13 and the control circuit 30 is closed by switching element 18 to permit operation of the machine.

While a specific embodiment of the invention has been shown and described in detail to illustrate the application of the principles of the invention, it will be understood that the invention may be embodied otherwise without departing from such principles.

What is claimed is:

1. A device for changing a form cylinder of a photogravure rotary machine, the cylinder having a shaft with a bearing at each end and a removable bearing housing engaged over each shaft bearing, the machine having a machine control and machine side walls, comprising: a guide connected to each of said side walls, a carriage slidably mounted on each of said guides for movement into and out of an operating position, said carriage having a saddle portion shaped for receiving a respective bearing housing, said carriage slidable along said guide into its operating position to bring a respective bearing housing on a respective saddle portion into an operating position for the form cylinder, a retaining fork pivotally mounted to each carriage and movable into an engagement position engaging a respective bearing housing to hold the respective bearing housing at a fixed axial position on a respective saddle portion, locking means connected to the side walls and engageable with said carriage in its operating position, for retaining said carriage in its operating position, an inclined member having an upper inclined surface position for engaging the cylinder shaft with said carriage moved out of its operating position, said inclined member connected to said side walls and spaced from said operating position of said carriage, and a return feed ratchet pivotally mounted to said inclined member movable into a locking position to retain the cylinder shaft on said upper inclined surface.

2. A device according to claim 1, wherein the side walls each have a stop surface, each carriage having an end face abutting said stop surface with each carriage in its operating position.

3. A device according to claim 1 including drive means connected to said carriage for moving said carriage from the operating position to the position in which the form cylinder is lifted by said incline member.

4. A device according to claim 1 wherein said locking means comprises a drive shaft rotatably mounted to the side walls, a lever connected to said drive shaft, a drive cylinder connected to said lever for rotating said drive shaft, said carriage having a recess, a bolt connected to said drive shaft engageable into said recess for retaining said carriage in the operating position.

* * * * *